United States Patent [19]

Chen

[11] Patent Number: 4,674,903

[45] Date of Patent: Jun. 23, 1987

[54] FOUNTAIN FACIAL CLEANSING SPONGE HEAD DEVICE

[76] Inventor: Teng-Mo Chen, 12-1, Lane 105, Hang-Cho S. Rd. Sec. 1, Taipei, Taiwan

[21] Appl. No.: 849,265

[22] Filed: Apr. 7, 1986

Related U.S. Application Data

[63] Continuation-in-part of Ser. No. 738,466, May 28, 1985, abandoned.

[51] Int. Cl.[4] ..... A45D 34/00; A47L 13/17

[52] U.S. Cl. ..... 401/266; 401/263; 401/183; 401/205; 401/207; 401/277

[58] Field of Search ..... 401/196, 183, 205, 207, 401/277, 266, 263, 261

[56] References Cited

U.S. PATENT DOCUMENTS

| | | | |
|---|---|---|---|
| 359,527 | 3/1887 | Wirz | 401/205 |
| 851,115 | 4/1907 | Burdick | 40/207 X |
| 2,048,689 | 7/1936 | Feasel | 401/205 |
| 2,962,743 | 12/1960 | Henriksson | 401/266 |
| 2,967,319 | 1/1961 | Bumpus et al. | 401/205 |
| 3,054,133 | 9/1962 | Hublard et al. | 401/205 |
| 3,106,742 | 10/1963 | Schultz et al. | 401/205 X |
| 4,089,609 | 5/1978 | Gring et al. | 401/207 X |

*Primary Examiner*—Steven A. Bratlie

*Attorney, Agent, or Firm*—Wenderoth, Lind & Ponack

[57] ABSTRACT

An improved formula facial cleansing device, in which a container is provided with a top cover having a sponge head mounted around a central tube. The outer surface of the sponge head is provided with several vertical grooves and the sponge head is mounted on the top cover with a tooth ring. The container can be closed or opened by means of a pad to control the flow of a liquid soap out of the container. When the container is squeezed, the liquid soap will be forced to flow to the top of the sponge head. Since the sponge head can absorb a lot of water or the like, it can generate a lot of foam for facial cleansing purposes.

1 Claim, 8 Drawing Figures

FOUNTAIN FACIAL CLEANSING SPONGE HEAD DEVICE

This application is a continuation-in-part of Ser. No. 738,466, filed on May 28, 1985 and now abandoned.

BACKGROUND OF THE INVENTION

To clean one's face the first step is usually to wash one's face or to remove make up and decorations. Generally, soap, cream, or other cleaning cosmetics are used for cleaning the face.

As a result of the advancement and modernization of our society, and the elevation of our living standards, both the facial cleaning cosmetics and facial cleaning method have become more particular than ever. Among these methods, there are the steam method, ultrasonic means or other methods and apparatuses; however, soap and face cream are still simple and popular facial cleaning cosmetics, which are usually applied to the face by hand and then washed away with water. Since the hands or fingers are unable to remove the oil and dirt on the skin and in the pores completely, various face-cleaning methods and apparatuses have been developed, and are available on the market.

After many years of experience in manufacturing and dealing with cosmetics, the inventor has, through careful studies and experiments, developed a simple and effective face-cleaning method and the apparatus thereof, i.e. a fountain facial cleansing device, which mainly comprises a sponge head made of soft and flexible material that can contain liquid to generate a lot of foam for cleaning the face. In the current market, there is not a face-cleaning apparatus which has the features of a sponge head according to the present invention. However, there is a shaving cream container disclosed in U.S. Pat. No. 4,089,609 which uses a sponge as the applicator body, but the device is quite different from the present invention in structure and method of operation. In the embodiment of that Patent, the applicator body is glued to a supporting base, whereas in the present invention, the sponge head is mounted through a tooth ring before being assembled in the top cover.

Further, the surface of the sponge head is furnished with several vertical grooves so as to generate more foam and provide friction effects to the skin. In the aforesaid patent, a pressurized container is used; as a result, the mechanism for controlling the ejection of shaving cream is very complicated.

In the present invention, only a special pad is used for controlling the flow of liquid soap so that its structure is simple, its manufacturing cost is low and it may be discarded after the liquid soap therein is used up, which is a sanitary feature of the invention. Although the aforesaid patent also has a tube member, its structure is different from that of the present invention. Another U.S. Pat., No. 2,962,743 has a sponge pad which is used for shoe cream, but the structure and assembling method are different from that of the present invention. Further, in U.S. Pat., No. 851,115, an envelope moistener has a "saw-tooth opening", which is also considerably different from the tooth ring of the present invention, since the bottom of the tooth ring is provided with pendent sharp legs to fasten the lower portion of the sponge head firmly without being disengaged from its position. In other words, the present invention is a substantial improvement over the prior art structures of any kind similar to the present invention.

SUMMARY OF THE INVENTION

This invention relates to a facial cleansing device, the major object of which is to improve the conventional face-cleaning method that uses hands or fingers to apply soap or facial cream to the facial skin, and also to improve the current face-cleaning apparatuses, such as brushes, sponge pieces or towels. In using the current apparatuses for cleaning the face, the soap or face cream must first be applied thereon or applied to the face directly before rubbing the face with one of these apparatuses which is complicated and burdensome to the user. In the present invention, a container for containing a cream or a liquid soap and a plastic sponge head having a central tube therethrough are assembled together to form a fountain type of face-cleaning device, which not only can provide simple and convenient operation, but also can increase the effectiveness of the cleaning procedure. Moreover, the present invention can save cream or the liquid soap consumption without affecting the cleaning result, thus has economical advantages.

It is another object of the present invention to provide a sponge head that has a feature of easily absorbing and containing liquid soap or face cream and generating a lot of foam upon rubbing the skin. Since the sponge head is rather soft and has a slightly coarse surface, it can remove the dirt and skin oil in the pores upon rubbing the skin. Therefore, the invention comprises a fountain type of facial cleansing sponge head device. In order to make more effective use of the sponge head, the surface of the sponge head is furnished with several vertical grooves.

It is still another object of the present invention to provide a soap or face cream that need not contact with the hands since the liquid soap or face cream can be directly applied to the face with the soft cleansing device. A central tube is provided for introducing the soap or cream near the top of the sponge head so that the soap cream is not absorbed before reaching the top which thus avoids wasting the liquid soap.

It is a further object of the present invention to provide a tooth ring to fasten the sponge head in place. Both the inner surface and the bottom of the tooth ring are furnished with teeth. This feature of the invention not only provides a better way to fasten the sponge head, but also makes the assembly procedures of the sponge head simple, and lowers the manufacturing cost.

It is still a further object of the present to provide a a pad for controlling the flowing or cutting off of the liquid soap or face cream. The structure of the pad is simple, but its function is significant and novel. Briefly, the whole device according to the present invention is simple in construction, low in manufacturing cost, and can be discarded after use for sanitary and safety reasons.

DESCRIPTION OF THE PREFERRED EMBODIMENT

Figure 1:
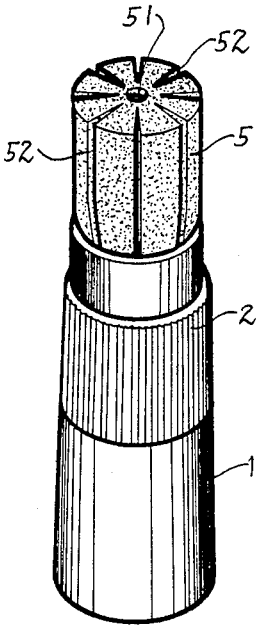
FIG. 1 is a perspective view of the present invention.
Figure 2:
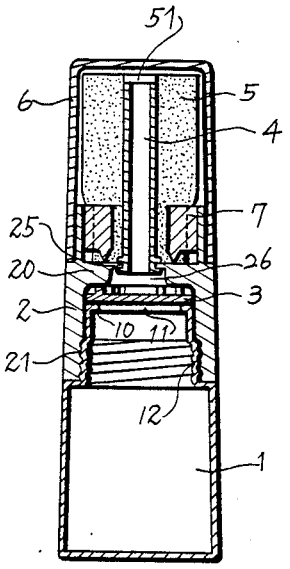
FIG. 2 is a sectional view of the present invention.
Figure 3:
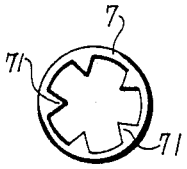
FIG. 3 is a top view of the tooth ring in the present invention.
Figure 4:
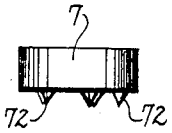
FIG. 4 is a side view of the tooth ring in FIG. 3.
Figure 5:
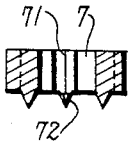
FIG. 5 is a sectional view of the ring in FIG. 3.

The device according to the present invention comprises a container 1, a top cover 2, a pad 3, a central tube 4, a sponge head 5, a tooth ring 7, and an outer cap 6. The shape of the container 1 may be varied, and it is used for storing a liquid soap or other suitable cream. The upper portion of the container 1 has an opening 11 within a flange edge 10, the outer surface of the upper portion having threads 12 so as to be engaged with the top cover 2. The top cover 2 includes two hollow sections, which are partitioned with a partition board 20. The inner surface of the lower section of the top cover 2 has threads 21 so as to screw together with the threads 12 on the container 1. The inner surface of the upper section of the top cover 2 is to be engaged with the tooth ring 7 that is used for mounting the sponge head 5. The tooth ring 7 as shown in FIGS. 3, 4, and 5 is formed into a ring shape, the interior of which is furnished with several sharp teeth 71, each of which has a sharp leg 72 projected downwards. The sponge head 5 is in a cylinder shape with the central tube 4 being mounted through a passageway 51.

Figure 6:
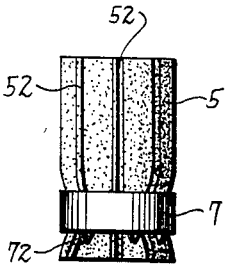
FIG. 6 illustrates the sponge head passing through the tooth ring during assembling.

To assemble, the sponge head 5 is inserted through the top of the tooth ring 7 and through the hole thereof such that the lower end of the sponge head is lower than the lower end of the sharp leg 72, as shown in FIG. 6. Since the sponge is a soft and elastic substance, the sponge will be fixed to the top cover 2 by the sharp legs 72 under the tooth ring 7 when the sponge and the tooth ring 7 are mounted in the upper section of the top cover 2. This way of mounting the sponge head 5 avoids the need to use adhesive, which would otherwise cause the sponge head to become disengaged from its position upon being contacted with soap, liquid or the like. Also, by using the tooth ring of the invention the manufacturing cost of mounting the sponge head is lowered. The outer surface of the sponge head 5 is provided with several vertical grooves 52 so as to increase the foam-generating function and the friction thereof.

Figure 7:
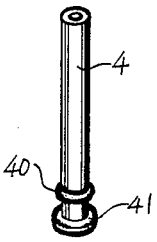
FIG. 7 is a perspective view of the central tube in the present invention.

Referring to FIG. 7, there is shown a central tube 4 made of soft elastic rubber, the lower portion of the tube 4 having upper and lower ring-shaped flanges 41 and 40. The partition board 20 of the top cover 2 has a central hole 25, in which a hollow ring-shaped cavity 26 is furnished for mounting the lower ring-shaped flanges 40 and 41 of the central tube 4. The tube 4 is inserted through the central hole 25 so as to have the top of the bottom ring-shaped flange 41 engaged with the bottom of the central hole 25 in the partition board 20, which prevents the central tube 4 from being pulled out. Simultaneously, the upper ring-shaped flange 40 is placed above the central hole 25 of the partition board 20 so as to prevent the central tube 4 from passing downwards. The central tube 4 has a length such that it extends to the top or slightly below the top of the sponge head 5 so as to let the liquid soap reach to the very end of the sponge head 5, to thereby prevent the liquid soap in the central tube from being absorbed as it passes through the passageway 51 of the sponge head 5. If the liquid soap is absorbed in the passageway 51, it will be wasted.

Figure 8:
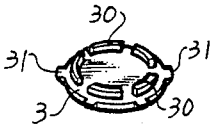
FIG. 8 is a perspective view of the present invention.

FIG. 8 illustrates a pad 3 which is mounted under the partition board 20. The bottom of the pad 3 is a flat surface, while the top surface thereof is furnished with several curved flanges 30, whereby a gap for liquid soap between the pad 3 and the partition board 20 can be maintained. On the circumferential edge of the pad 3 there are provided several lateral lugs 31, which center the pad 3 against the inner surface of the top cover 2, and which can also provide some gaps to let the liquid soap flow through. Upon the top cover 2 being screwed tightly, the flange edge 10 of the opening 11 of the container 1 will be in close contact with the bottom surface of the pad 3. When using the device, the top cover 2 is unscrewed to have the flange edge 10 of the opening 11 separated from the bottom of the pad 3 to let the liquid soap flow, through the gap around the circumferential edge and on the top of the pad 3 and into the central tube 4, to the top of the sponge head 5 upon a pressure being applied to the container. Once the top of the sponge head 5 is overflowed with sufficient liquid soap, the top cover is screwed tightly to cut off the flowing liquid soap. The use and control of the device according to the present invention is simple and convenient.

When not in use, the outer cap 6 is put over the top cover 2 so as to maintain the sponge head always in a clean condition.

I claim:

1. An improved fountain facial cleansing sponge head device comprising:

a container having an upper end with an inwardly extending flange defining an opening in said upper end of said container, said container having an outer surface at said upper end thereof which is threaded;

a top cover having a hollow upper section and a hollow lower section separated by a partition board, said lower section having an inner surface which is threaded for attaching said top cover to said container, said partition board extending inwardly from said upper and lower sections and having a central hole therein, said partition board defining a cavity between said top cover and said upper end of said container when said top cover is attached to said container;

a pad disposed between said upper end of said container and said partition board of said top cover, said pad having a flat bottom surface which is adapted to seal said upper end of said container when said pad is held in tight contact against said upper end of said container, said pad having a plurality of curved flanges extending from a top surface thereof and said pad having a plurality of lateral lugs extending outwardly from an edge thereof between said top and bottom surfaces;

a flexible central tube having a pair of ring-shaped flanges at a lower end thereof, said pair of ring-shaped flanges being mounted on either side of said central hole in said partition board of said top cover;

a sponge head having an elongated shape which extends in a longitudinal direction, said sponge head having a plurality of grooves which extend in said longitudinal direction on an outer surface thereof and said sponge head having a central passageway extending in said longitudinal direction with said central tube disposed within said central passageway of said sponge head;

a tooth ring having an upper surface and a lower surface with a plurality of sharp teeth extending inwardly from an inner surface of said tooth ring and a plurality of sharp legs extending from said sharp teeth in a direction away from said lower surface of said tooth ring, said tooth ring extending around a lower portion of said sponge head and positioned in said hollow upper section of said top cover, whereby said sponge head is held between said tooth ring and said central tube; and an outer cap removably fitted to said top cover for enclosing said sponge head when said sponge head is not in use.

* * * * *